US012663003B2

(12) United States Patent
Soyke et al.

(10) Patent No.: US 12,663,003 B2
(45) Date of Patent: Jun. 23, 2026

(54) DOUBLE DIAPHRAGM PUMP

(71) Applicant: Unibloc Hygienic Technologies UK, Ltd., Bolney (GB)

(72) Inventors: Sebastian Antoni Soyke, Bolney (GB); Robert George Grantham-Hill, Southwater (GB)

(73) Assignee: Unibloc Hygienic Technologies UK, Ltd., Bolney (GB)

( * ) Notice: Subject to any disclaimer, the term of this patent is extended or adjusted under 35 U.S.C. 154(b) by 36 days.

(21) Appl. No.: 18/905,593

(22) Filed: Oct. 3, 2024

(65) Prior Publication Data

US 2025/0116269 A1 Apr. 10, 2025

Related U.S. Application Data

(60) Provisional application No. 63/542,333, filed on Oct. 4, 2023.

(51) Int. Cl.
*F04B 53/10* (2006.01)
*F04B 43/073* (2006.01)
*F04B 45/04* (2006.01)

(52) U.S. Cl.
CPC ..... *F04B 53/1007* (2013.01); *F04B 43/0736* (2013.01); *F04B 45/043* (2013.01)

(58) Field of Classification Search
CPC ..... F04B 43/0733; F04B 43/0736; F04B 45/043; F04B 53/1007; F04B 53/1087
See application file for complete search history.

(56) References Cited

U.S. PATENT DOCUMENTS 6,142,749 A * 11/2000 Jack ..... F04B 53/1002 92/99
6,168,394 B1 * 1/2001 Forman ..... F04B 43/0736 417/393
2003/0024571 A1 * 2/2003 Simmons ..... F16K 43/00 137/329.05
2005/0249621 A1 * 11/2005 Bethel ..... F04B 53/1002 417/559
2014/0334957 A1 * 11/2014 Simmons ..... F04B 53/1002 417/559
2021/0108630 A1 * 4/2021 Yamada ..... F04B 43/0736
2022/0372969 A1 * 11/2022 Hines ..... F04B 53/22
2023/0265845 A1 * 8/2023 Morris ..... F04B 53/1002 417/472
2024/0392770 A1 * 11/2024 Anderson ..... F04B 53/06

* cited by examiner

*Primary Examiner* — Jonathan R Matthias
(74) *Attorney, Agent, or Firm* — Miller & Martin PLLC

(57) ABSTRACT

An improvement to an air operated double diaphragm pump may include ball guides to restrain movement of balls relative to suction and delivery seats to substantially linear travel, as opposed to the prior art three-dimensional travel. The guides may have curved surfaces to reduce wear on balls over prior art designs. The pumps may have supports and an intake manifold whereby the intake manifold may be removed to access the intake balls and intake ball valve seals without requiring the pump to be completely removed from an installation as is required with prior art designs.

9 Claims, 8 Drawing Sheets

DOUBLE DIAPHRAGM PUMP

CLAIM OF PRIORITY

This application claims the benefit of U.S. Provisional Application No. 63/542,333 filed Oct. 4, 2023, which is incorporated herein by reference in its entirety.

FIELD OF THE INVENTION

The present invention relates to diaphragm pumps and more particularly to double diaphragms having valve balls at suction and delivery manifolds selectively enabling one of two chambers to fill and exhaust fluid, respectively and alternatingly.

BACKGROUND OF THE INVENTION

Double diaphragm pumps have been around for a long time. The applicant owns U.S. Pat. No. 8,469,681 for a double diaphragm pump. Other companies have other designs.

In the applicant's double diaphragm pumps, there are suction and delivery valve balls that seal on seats depending on which of two fluid chambers are filling with or exhausting fluid. The respective suction valve balls for each fluid chamber selectively seal near the suction when the other fluid chamber is intaking fluid. Delivery valve balls selectively seal on seats near the discharge or outlet as the other fluid chamber discharges. When one fluid chamber is filling, the other is sealed off at the suction with its suction valve ball. When one fluid chamber is discharging fluid, the other fluid chamber's discharge is sealed off with its delivery valve ball. Also, as one fluid chamber fills, the other discharges in an alternating manner.

In the prior art cross section as can be seen in FIG. 1, a double diaphragm pump 2 has suction valve balls 3,4 proximate to inlet 5 and delivery valve balls 6,7 proximate to outlet 8. As one can see in this cutaway drawing, the valve balls 3,4,6,7 have three axes of motion as they move on and off their respective seats 9,10,11,12 about cavities 13,14,15,16.

Specifically, suction valve balls 3,4 move upwardly into cavities 13,14 respectively when fluid is passing by the respective suction valve ball 3 or 4. When discharging past delivery valve balls 6,7 the delivery valve balls 6 and 7 respectively move into their respective cavity 15,16 as fluid passes thereby. At their respective fluid chamber is either acquiring fluid as it relates to the intake or suction past suction valve balls 3,4 or discharging past the delivery valve balls 6,7 as appropriate, the respective valve balls 3,4,6,7 move into the respective cavity 13,14,15,16. The valve balls 3,4,6,7 move in all directions 18,19,21 about the cavities 13,14,15,16, whereby additional wear on the valve balls 3,4,6,7 is caused by the movement of the valve balls 3,4,6,7, in all directions within the cavities 13,14,15,16, leading them to make contact with various surfaces & intersecting sharp, thus requiring the valve ball 3, 4, 6 or 7 and its regular seat 9 or 10, 11 or 12 to require replacement over time.

Additionally, in prior art designs accessing the suction valve balls 3,4 or seats 9,10 at the suction is difficult. A maintenance technician typically must remove the entire pump 2 from its installed location so as to be able to access and remove the lower manifold 17 to be able to inspect and/or replace the suction valve balls 3,4, and/or seats 9,10.

Improvements over prior art designs are believed to be desirable in the marketplace.

SUMMARY OF THE INVENTION

It is an object of many embodiments of the present invention to provide an improved inspect/repair-in-place capability for a new double diaphragm pump which has an ability to remove the bottom manifold while the pump remains in place.

It is another object of the present invention in at least some embodiments to provide ball guides within the manifolds which significantly limit valve ball travel during operation primarily along a single axis of motion.

It is another object of the present invention to provide an improved double diaphragm pump.

Accordingly, in accordance with a presently preferred embodiment of the present invention, a double diaphragm pump is supported at an elevation above a horizontal surface such as on legs whereby the lower manifold which normally provides a suction to the pump may be removed from the pump while the pump body remains in place so as to access the lower pair of valve balls for inspection and/or replacement along with the lower seals and/or lower manifold. These valve balls normally act on seats near the lower manifold selectively when alternating between filling the two fluid chambers of the pump.

Another feature of many embodiments of the pump as shown herein, are ball guides which act on the suction valve balls near the intake or suction manifold and/or ball guides which act on the delivery valve balls at or near the discharge manifold or outlet. These ball guides restrict valve ball movement away from sharp edge contact. The ball guides preferably have inner faces which have curvatures which approximate the valve ball curvature so as to prevent harsh contact of the balls with inner walls of the manifold or surfaces adjacent to or within the cavities. For many embodiments, these ball guides essentially limit the movement of the valve balls to substantially linear travel along a single axis on and off the respective seat. By limiting the valve balls degree of motion and providing the rounded surfaces to contact, life of the valve balls is estimated to be greatly increased for at least some embodiments.

BRIEF DESCRIPTION OF DRAWINGS

The particular features and advantages of the invention as well as other objects will become apparent from the following description taken in connection with the accompanying drawings in which.

DETAILED DESCRIPTION OF THE PREFERRED EMBODIMENTS

Figure 2:
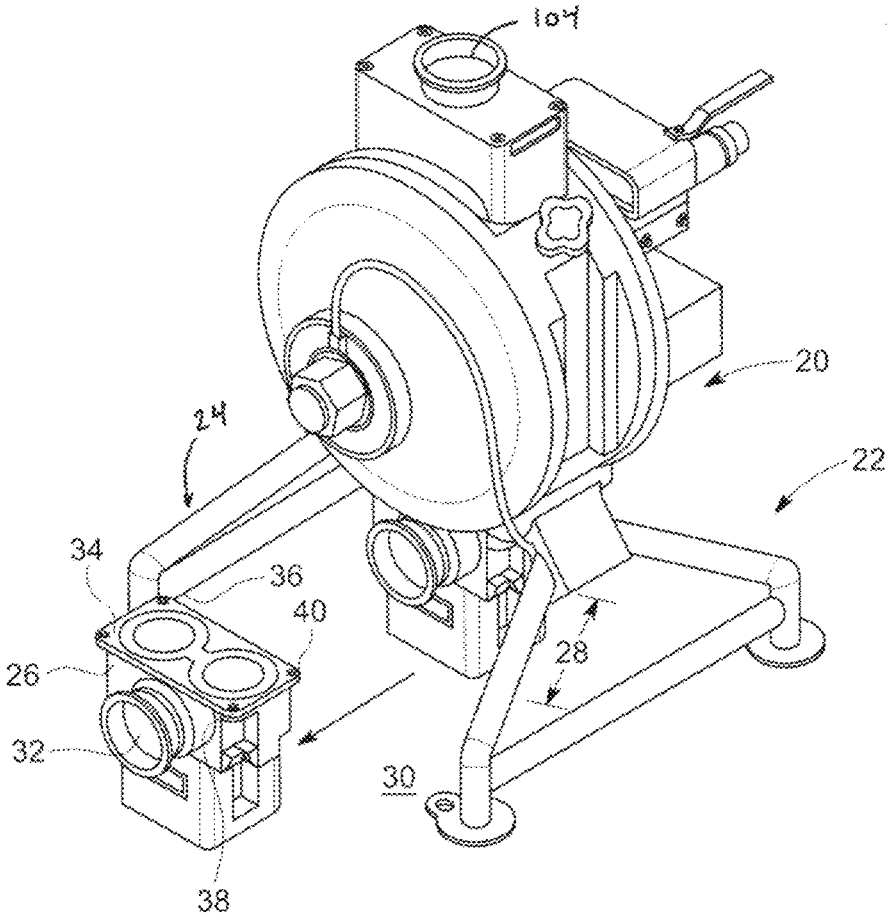
FIG. 2 is a front perspective partially exploded plan view of a pump constructed in accordance with the presently preferred embodiment of the present invention showing how to remove the lower manifold.
Figure 3:
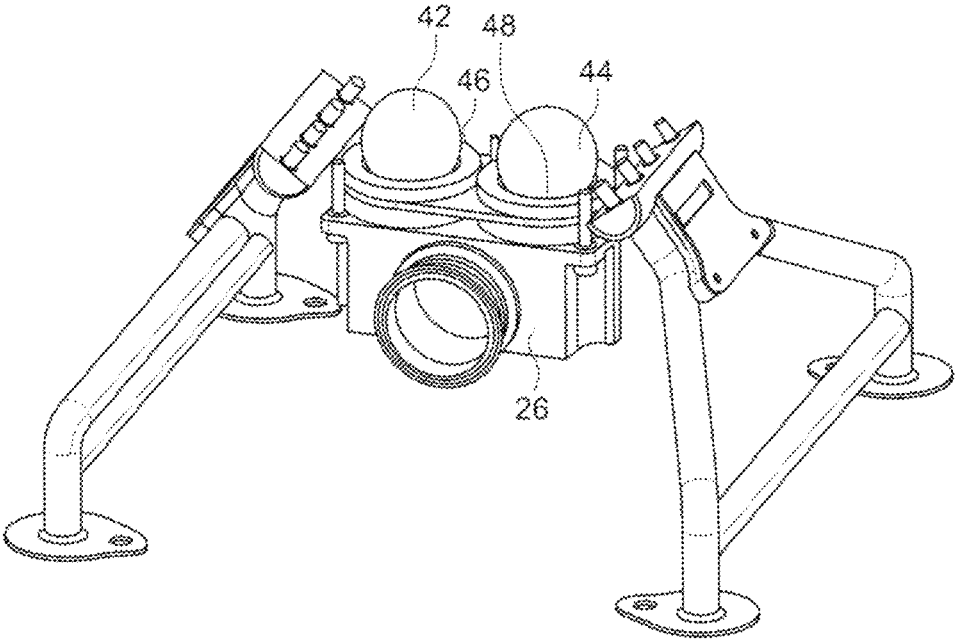
FIG. 3 shows both diaphragms and pump body removed relative to the lower manifold and legs.

FIG. 2 shows a pump 20 of a presently preferred embodiment of the present invention. Pump 20 has at least a first support 22 if not first and second supports 22,24, preferably in the form of legs or other structure which elevates a bottom manifold 26 a distance or elevation 28 above a horizontal surface 30 such as a plant floor or other structure. By elevating the lower manifold with the suction connection or inlet 32 above the horizontal surface 30, an operator may remove bolts or other connectors to remove the lower or bottom manifold 26 from the pump 20 such as by removing the connectors or bolts which would proceed through bores 34,36,38,40 etc., and then be able to remove the bottom manifold 26 as illustrated from the pump body 50. This capability permits the operator to inspect suction valve balls 42,44 and/or seats 46,48. To the applicant's knowledge, no competitor has such a capability.

While a removable lower or bottom manifold 26 while the pump body 50 remains in place is certainly an attractive feature for many embodiments not all embodiments need to have such a feature.

Figure 1:
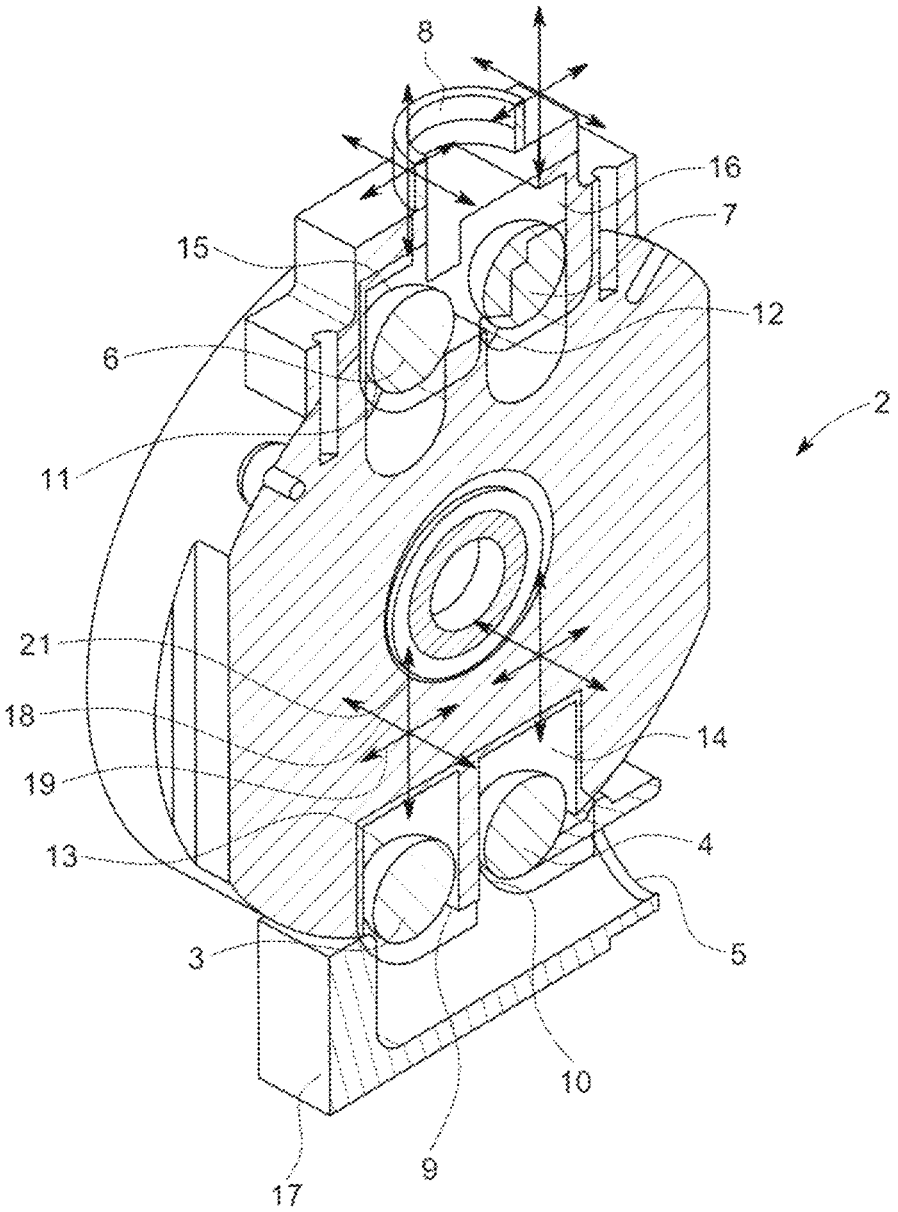
FIG. 1 (PRIOR ART)
FIG. 1 is a cross-section of a pump of prior art design.
Figure 4:
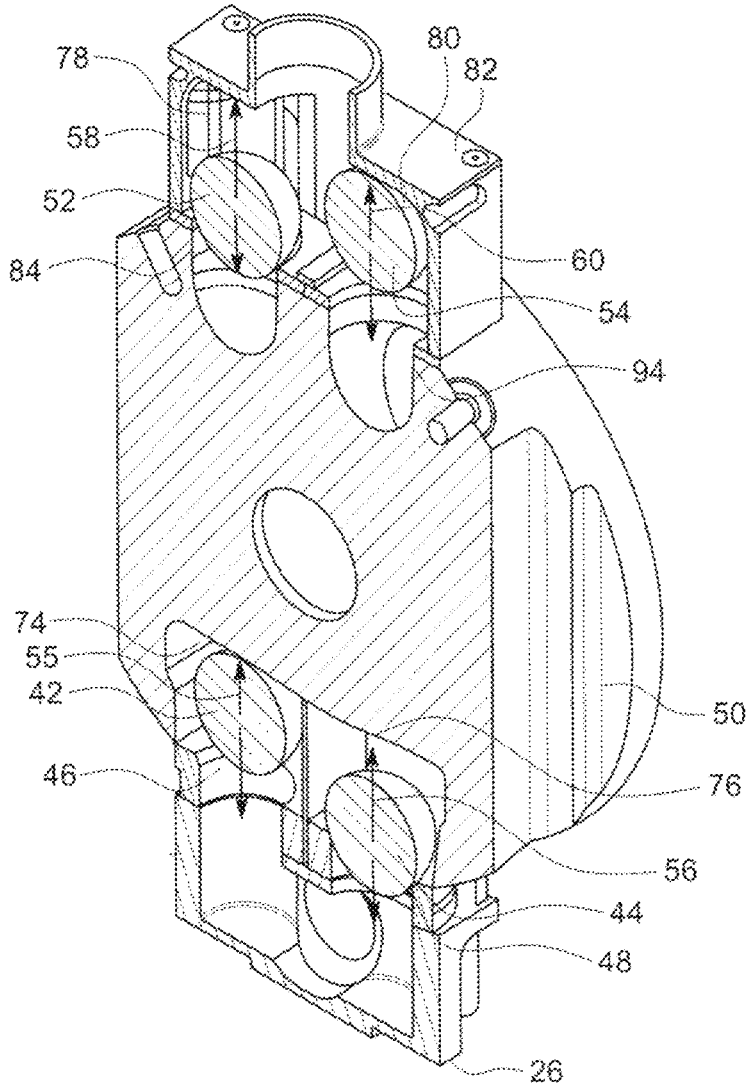
FIG. 4 shows a cross-section of the pump of FIG. 2 showing that motion of the balls has been restrained to essentially along the single axis of motion.
Figure 5:
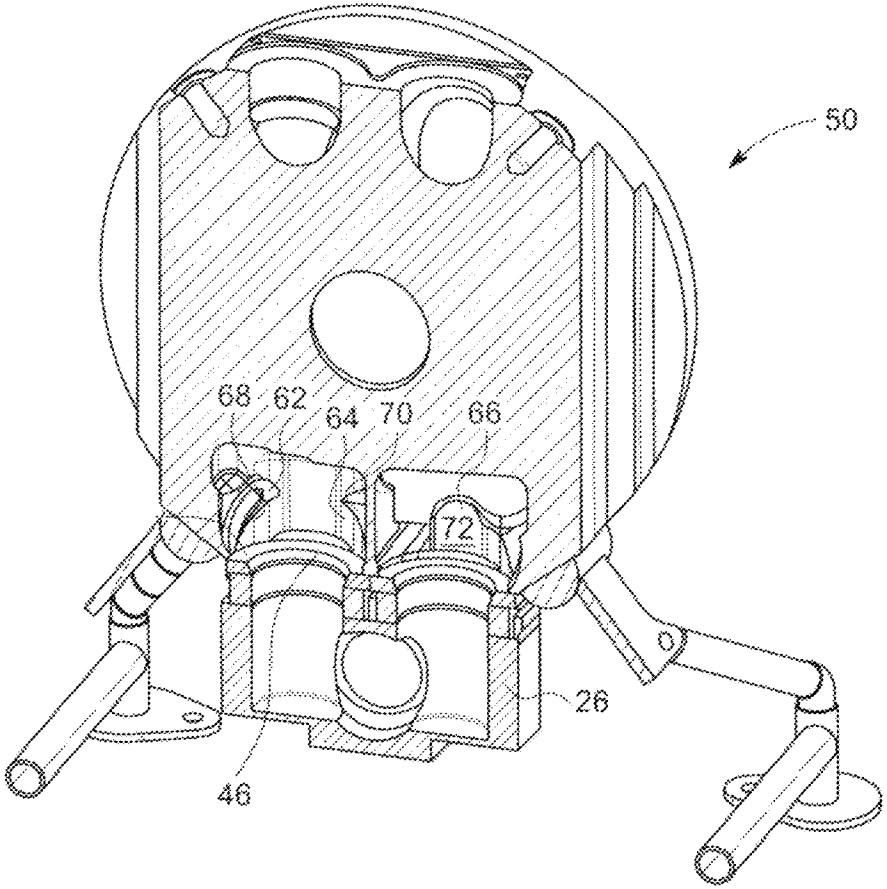
FIG. 5 is a cross-sectional view similar to FIG. 4 with the ball guides shown in detail with the valve balls of FIG. 5 removed.

Another feature of the present embodiment can be seen with reference to FIG. 4 when compared to FIG. 1. Namely, the suction valve balls 42,44 and/or the delivery valve balls 52,54 are preferably restrained so as to have essentially a single axis of motion illustrated as axes 55,56,58,60 as opposed to three degrees of motion illustrated in FIG. 1 for each of the various balls 3,4,6,7, suction cavities 13,14,15,16. This feature may be accomplished through the use of guides as will be discussed in further detail below.

Figure 6:
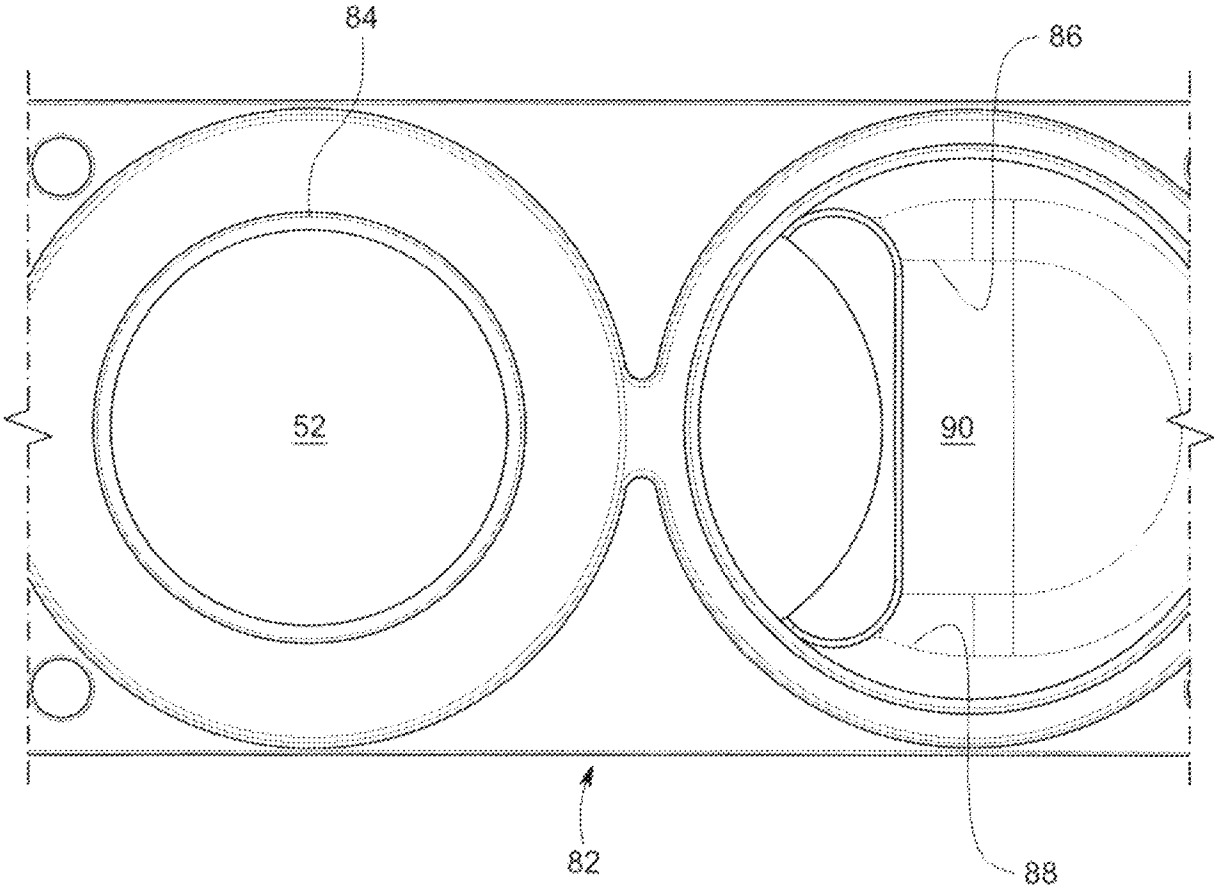
FIG. 6 shows a bottom plan view of the top manifold removed from the pump with a valve ball being shown in place.

FIG. 6 shows a cross section of the pump 20 shown in FIG. 4. A cross section of manifold 26 shows the first suction valve ball 42 relative to its seat 46. First, second and third guide portions 62,64,66 are shown limiting the travel of the suction valve ball 42 (similar or dissimilar structure 44) so that the suction valve balls 42,44 can only travel substantially linearly, such up and down and may be restrained from side to side motion (or otherwise along other axes). The interior of the guide portions have inner surfaces 68,70,72 which are preferably curved somewhat close to the same radius of curvature of the surfaces of the suction valve balls 42,44 so there are preferably few or no sharp edges that as the suction valve ball 42,44 moves up and down along respective axis 55,56, instead of striking the inner confines of the affected fluid chamber 74,76,78,80 or contacting sharp edges, restricting the motion to linear in the fluid chambers 74,76 and to only contact curved surfaces 68,70,72 of guides which contact the valve ball 42,44,52,54, provides for distributed load on the surfaces of the suction valve balls 42,44 to increase their lifespan and prevent other problems that may have existed in prior art designs.

Figure 8:
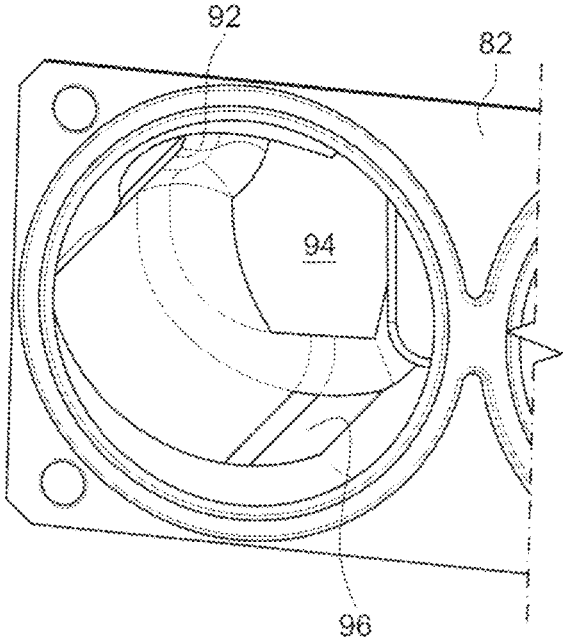
FIG. 8 shows a side perspective view of the internals of the upper manifold.

FIG. 6 shows a bottom view of the upper manifold 82 with discharge ball 52 on the seat 84. The second ball 54 is not shown but guides 86,88,90 are shown which restrict the ball from traveling in essentially a linear orientation. These guides 86,88,90 are shown having curved surfaces (similar to the curvature of balls 52,54) like the lower guides. FIG. 8 shows the same manifold 82 with the ball removed.

Figure 7:
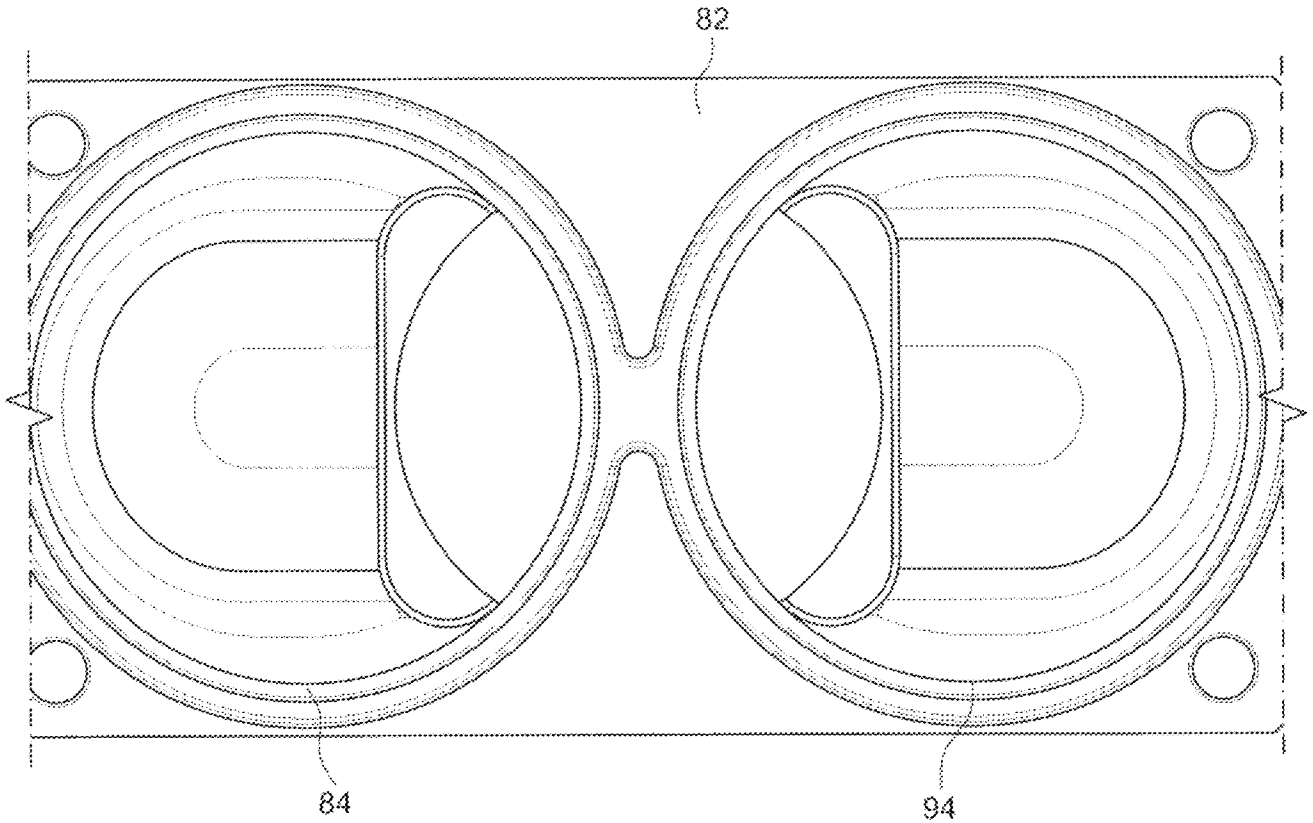
FIG. 7 shows a bottom plan view at the top manifold similar to FIG. 6 with the valve balls removed.

FIGS. 7 and 8 also show this manifold 82 with various guides 92,94,96 which preferably have curved surfaces to accommodate the diameter slightly larger than the diameter of the ball 52 and preventing the ball 52,54 from contacting rough surfaces as the ball moves on and off the respective seats proximate to guides 84,94 as would be understood by those of ordinary skill in the art. Motion of the balls 52,54 is preferably substantially linearly in the cavities or fluid chambers 78,80.

Figure 9:
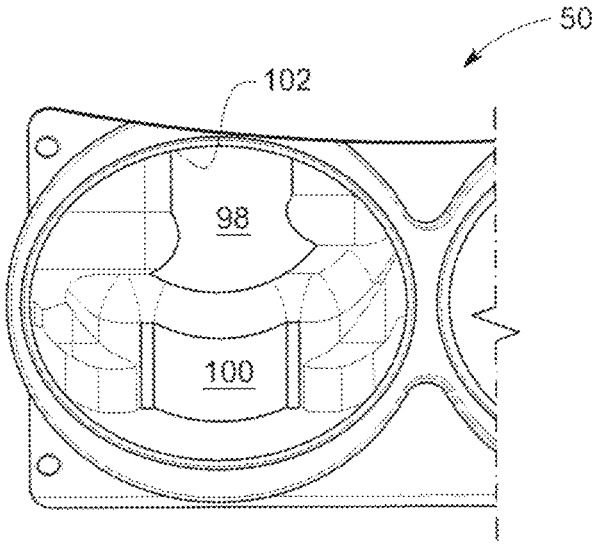
FIG. 9 shows a top plan view of the bottom plan view of the bottom of the pump of the lower manifold removed along with the valve balls.

FIG. 9 is useful to show a top view of a bottom view of the pump body 50 above the lower manifold showing the guides 100,102 which assist in maintaining the ball 42 in the desired location as it relates to forward and sideways while allowing principally or substantively only reciprocating (linear) movement of the ball 52. There are preferably at least three guides per fluid chamber 74,76,78,80 so that the valve balls 42,44,52,54 preferably do not contact rough surfaces within either the pump body 50 as it relates to the suction valve balls 42,44 and within the upper manifold 82 as it relates to the delivery valve balls 52,54 as fluid leaves the outlet 104 as understood by those of ordinary skill in the art.

As it relates to the inspect and repair feature of the lower manifold 26, a user can disconnect lower manifold 26 from the pump body 50 and then move it as illustrated in FIG. 2. The seats 46,48 on the lower manifold 26 are easily accessible and the suction valve balls 42,44 may drop out of the pump body 50 for replacement and/or inspection. Reversing the process can then be done to reassemble the pump 20. By having the pump body 50 suspended above the horizontal surface 30 by elevation 28 sufficient clearance is provided while maintaining the pump body 50 connected to the legs and the vertical surface 30 during these procedures.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

What is claimed is:

1. In a double diaphragm pump having an intake and an outlet each in communication with first and second chambers, and balls located proximate to suction and delivery seats of each of the first and second chambers, wherein said pump selectively and alternatingly directs fluid into one of the first and second chambers with first and second air diaphragms with the ball displaced from its suction seat and the other of the first and second chambers having the ball at its suction seat preventing flow into the other of the first and second chambers while filling the one of the first and second chambers with the first air diaphragm pulling a suction on the one of the first and second chambers, while the second air diaphragm expels fluid from the other of the first and second chambers with the ball displaced from its delivery seat, and the ball at the delivery seat of the one of the first and second chambers prevents flow into the one of first and second chamber, and the balls being located between the first and second air diaphragms, the improvement comprising:

ball guides proximate to the suction seats, said ball guides limiting the movement of the balls on and off the suction seats to substantially linear travel on and off the suction seats; wherein said ball guides having interior concavely curved surfaces substantially corresponding to a diameter of the balls thereby limiting travel to substantially linearly on and off the suction seats at the suction seats.

2. The improvement of claim 1 wherein the ball guides have portions proximate to the delivery seats, said ball guides limiting the movement of the balls on and off the delivery seats to substantially linear travel on and off the delivery seats.

3. The improvement of claim 2 wherein the ball guides have interior curved surfaces substantially corresponding to a diameter of the balls thereby limiting travel to substantially linearly on and off the delivery seats.

4. The improvement of claim 1 further comprising a support and an intake manifold, and wherein the intake is located in the intake manifold, said manifold having the suction seats with its respective ball alternatingly sealing thereon, and the support elevating the manifold to a position above a lower surface of the support permitting the removal of the manifold without requiring removal of the pump from its installed location.

5. The improvement of claim 4 wherein the support further comprises feet extending downwardly from the pump.

6. In a double diaphragm pump having an intake and an outlet each in communication with first and second chambers, and balls located proximate to suction and delivery seats of each of the first and second chambers, wherein said pump selectively and alternatingly directs fluid into one of the first and second chambers with first and second air diaphragms with the ball displaced from its suction seat and the other of the first and second chambers having the ball at its suction seat preventing flow into the other of the first and second chambers while filling the one of the first and second chambers with the first air diaphragm pulling a suction on the one of the first and second chambers, while the second air diaphragm expels fluid from the other of the first and second chambers with the ball displaced from its delivery seat, and the ball at the delivery seat of the one of the first and second chambers prevents flow into the one of first and second chamber, and the balls being located between the first and second air diaphragms, the improvement comprising:

ball guides proximate to the delivery seats, said ball guides limiting the movement of the balls on and off the delivery seats to substantially linear travel on and off the delivery seats; wherein said ball guides having interior concavely curved surfaces substantially corresponding to a diameter of the balls thereby limiting travel to substantially linearly on and off the delivery seats at the delivery seats.

7. The improvement of claim 6 further comprising a support and an intake manifold, and wherein the intake is located in the intake manifold, said manifold having the suction seats with its respective ball alternatingly sealing thereon, and the support elevating the manifold to a position above a lower surface of the support permitting the removal of the manifold without requiring removal of the pump from its installed location.

8. The improvement of claim 7 wherein the support further comprises feet extending downwardly from the pump.

9. In a double diaphragm pump having a pump body, an intake and an outlet each in communication with first and second chambers, and balls located proximate to suction and delivery seats of each of the first and second chambers, wherein said pump selectively and alternatingly directs fluid into one of the first and second chambers with first and second air diaphragms with the ball displaced from its suction seat and the other of the first and second chambers having the ball at its suction seat preventing flow into the other of the first and second chambers while filling the one of the first and second chambers with the first air diaphragm pulling a suction on the one of the first and second chambers, while the second air diaphragm expels fluid from the other of the first and second chambers with the ball displaced from its delivery seat, and the ball at the delivery seat of the one of the first and second chambers prevents flow into the one of first and second chamber, and the balls being located between the first and second air diaphragms, the improvement comprising:

a first and second supports and an intake manifold, and wherein the intake is located in the intake manifold, said manifold having the suction seats with its respective ball alternatingly sealing thereon, and the first and second supports connecting to the pump body at spaced apart locations with the balls being located between the first and second supports, and said first and second supports elevating the manifold to a position above a lower surface of the support permitting the removal of the manifold without requiring removal of the pump from its installed location.

* * * * *